US008072145B2

(12) United States Patent
Kasaishi et al.

(10) Patent No.: US 8,072,145 B2
(45) Date of Patent: Dec. 6, 2011

(54) EXTRA HIGH PRESSURE MERCURY LAMP WITH EACH ELECTRODE HELD BY A SEALING PORTION

(75) Inventors: Shuki Kasaishi, Hyogo (JP); Takuya Tsukamoto, Hyogo (JP); Nobuhiko Sugihara, Hyogo (JP); Toyohiko Kumada, Hyogo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 72 days.

(21) Appl. No.: 12/656,387

(22) Filed: Jan. 28, 2010

(65) Prior Publication Data

US 2010/0187993 A1 Jul. 29, 2010

(30) Foreign Application Priority Data

Jan. 29, 2009 (JP) ..... 2009-017875

(51) Int. Cl.
*H01J 61/18* (2006.01)
*H01J 61/06* (2006.01)

(52) U.S. Cl. ..... 313/623; 313/570; 313/331

(58) Field of Classification Search ..... 313/631, 313/570, 571, 623, 626, 639, 331
See application file for complete search history.

(56) References Cited

U.S. PATENT DOCUMENTS

| | | | |
|---|---|---|---|
| 4,983,881 | A | 1/1991 | Eliasson et al. |
| 6,903,509 | B2 | 6/2005 | Kanzaki |
| 7,800,308 | B2 | 9/2010 | Oda et al. |
| 2010/0188855 | A1 | 7/2010 | Sakaguchi et al. |

FOREIGN PATENT DOCUMENTS

| | | | |
|---|---|---|---|
| JP | 64-059754 | | 3/1989 |
| JP | H02-007353 | A | 1/1990 |
| JP | 2007-280823 | A | 10/2007 |
| JP | 2008-071718 | A | 3/2008 |
| KR | 10-2009-0023065 | | 3/2009 |
| WO | WO-2009/011117 | A1 | 1/2009 |

*Primary Examiner* — Joseph L Williams
(74) *Attorney, Agent, or Firm* — Rader, Fishman & Grauer PLLC

(57) ABSTRACT

An extra high pressure mercury lamp that includes an arc tube, which includes a light emission section enclosing 0.2 mg/mm$^3$ or more of mercury, sealing sections that respectively extend from both ends of the light emission section, a pair of electrodes that face each other in the light emission section, wherein an electrode axis portion of each electrode is held by the sealing portion, and a metallic foil that is buried in the sealing section and that is electrically connected with the electrode axis portion, wherein the metallic foil has a covering portion fixed to the electrode axis portion so as to roll up the electrode axis portion; an extended portion that extends towards the outside of a tube axis without being connected with the electrode axis portion; and a main body portion that extends from the extended portion.

3 Claims, 9 Drawing Sheets

Prior Art

EXTRA HIGH PRESSURE MERCURY LAMP WITH EACH ELECTRODE HELD BY A SEALING PORTION

CROSS-REFERENCES TO RELATED APPLICATION

This application claims priority from Japanese Patent Application Serial No. 2009-017875 filed Jan. 29, 2009, the contents of which are incorporated herein by reference in its entirety.

TECHNICAL FIELD

The present invention relates to an extra high pressure mercury lamp used as a light source of, for example, a projector.

BACKGROUND

Conventionally, a metal halide lamp in which mercury or metal halide is enclosed in an arc tube is widely used as a light source for a projection type projector apparatus, which is typified by a DLP etc., that uses a liquid crystal projector or a DMD to uniformly project an image with sufficient color rendering properties onto a rectangular screen.

In recent years, the demand for more miniaturization and realization of a point light source in such a projector apparatus an extra high pressure mercury lamp in which a mercury vapor pressure therein at time of lighting becomes 150 atmospheric pressure or more is mainly used instead of the metal halide lamp. Where such an extra high pressure mercury lamp is used as a light source, since a spread of an electric discharge arc can be suppressed due to very high mercury vapor pressure, it is possible to further improve the optical output.

Such an extra high pressure mercury lamp will be explained below, referring to FIG. 9. The extra high pressure mercury lamp comprises: an arc tube 11 which is made of, for example, quartz glass, and which has a spherical light emission section 12 including a sealed space there inside; and sealing portions 13 which are in a shape of a rod and extend continuously from both ends of the light emission section 12 along with a tube axis thereof, respectively. A pair of electrodes 20 which face each other is arranged in the light emission section 12, so that each electrode 20 is electrically connected, through a metallic foil 30 which is buried air tightly in each sealing portion 13 so as to extend along with the tube axis thereof, with an external lead 15 provided so as to project and extend outward from an outer face of the sealing portion 13. In the light emission section 12 of the extra high pressure mercury lamp, for example, mercury of 0.15 mg/mm$^3$ or more is enclosed, wherein the mercury vapor pressure of the light emission section 12 becomes 150 atmospheric pressure or more at time of lighting.

Since, in the extra high pressure mercury lamp having the above-mentioned structure, the pressure in the light emission section 12 becomes very high at time of lighting, problems occur like the enclosed gas leaks from cracks in the sealing portions 13. In order to solve such problems, it is required that glass which forms the sealing portions 13 be sufficiently and firmly brought into close contact with the respective electrode axis portions 21 and metallic foils 30 for electric supply.

In prior art, for example, in a state where quartz glass, which forms an arc tube making material, is heated at a high temperature, such as 2,000 degree Celsius or more, the sealing portions 13 are formed by gradually shrinking the thick quartz glass, thereby improving the adhesiveness between the quartz glass, and the respective electrode axis portions 21 and metallic foil 30 for electric supply in the sealing portions 13.

However, if the glass was burned at a high temperature, although the adhesiveness between the glass, and the respective electrode axis portions 21 and metallic foil 30 was improved, there was a problem that the sealing portions 13 tend to be damaged after a lamp was built.

This was because, when the temperature of the sealing portions 13 gradually falls after the heating treatment, since the expansion coefficient of, for example, tungsten which formed the electrodes 20 is one or more digit larger than that of, for example, quartz glass which formed the sealing portions 13, cracks occur in contact portions thereof due to relative difference of the amount of expansion of the tungsten and that of the quartz glass. Although the cracks produced at the time of lamp manufacturing were very small in an early stage, they grew up during lamp lighting when the inside of the light emission section 12 became extremely high in pressure. Over time, the cracks became a damage factor for the sealing portions 13 of the lamp.

Although such a problem never occurred when the pressure of the light emission section 12 of the lamp was low, it was a characteristic problem of the lamp in which the inside of the light emission section 12 was high in pressure, such as 150 atmospheric pressure or more, at time of lighting.

The inventors found out that when the high pressure in the light emission section at time of lamp lighting was applied to a gap which was inevitably formed near a joint of an electrode axis portion and a metallic foil, cracks were produced, thereby assisting growth of the gap, so that it was thought that the above-mentioned problems could be solved by making the gap small as much as possible. For example, in Japanese Patent Application Publication No. 2003-257373, an extra high pressure mercury lamp is proposed, in which a metallic foil 100 which has the structure shown in FIG. 8 is used to form a sealing portion.

The structure of the metallic foil 100 of this extra high pressure mercury lamp (FIG. 8) will be explained below. In this metallic foil 100, at the center in a width direction of a strip shaped metal plate (foil making material), a curve groove portion 101, which curves circularly, is formed so as to extend in a longitudinal direction, wherein one end portion of the curve groove portion 101 projects in a longitudinal and outside direction from one end edge of a flat section 105, which is a plate shape and which extends from both side edges of the curve groove portion 101, and extends in a width direction, that is, the full length of the curve groove portion 101 is larger than the full length of the flat section 105.

A base side portion of the electrode axis portion 21 is joined to the projection portion 102 of the curve groove portion 101 of this metallic foil 100 in a state so that an end portion face thereof is located outside the flat section 105 in a longitudinal direction and away from the one end edge of the flat section 105 of the metallic foil 100. In addition, a tip side portion of the external lead 15 is joined to an end portion in the other side of the curve groove portion 101. The Japanese Patent Application Publication No. 2003-257373 teaches that, in the extra high pressure mercury lamp for which the metallic foil 100 of such a structure is used, since the gap which is inevitably produced between the electrode axis portion 21 and the metallic foil 100 (at a position near the joint) can be made small as much as possible, even if the high pressure in the light emission section is applied to the gap at time of lamp lighting, it is possible to prevent generation of the cracks.

SUMMARY

However, in the extra high pressure mercury lamp disclosed in the Japanese Patent Application Publication, the metallic foil 100 turned out to often meltdown as explained below. Since the material of the electrode axis portion 21 and that of the metallic foil 100 were different from each other, the degree of attachment of the electrode axis portion 21 to quartz glass and that of metallic foil 100 to the quartz glass were not equal in an area near the joint of the electrode axis portion 21 and the metallic foil 100. Therefore, the electrode axis portion 21 was curved due to the thermal expansion and heat contraction at time of lighting of the extra high pressure mercury lamp. It was thought that as a result, the thickness of the metallic foil 100 becomes small at the joint area of the metallic foil 100 and the electrode axis portion 21, so that the electric resistance of this portion became high and the temperature thereof rises locally, whereby it fused at time of lighting of the extra high pressure mercury lamp.

In recent years, since higher brightness is called for from a light source for a projector apparatus, the quantity of the mercury enclosed in the light emission section has increased, compared with the conventional lamp. For example, although generally 0.15 mg/mm$^3$ of mercury or more was conventionally enclosed in an extra high pressure mercury lamp, recent years have shown that 0.2 mg/mm$^3$ or more is generally enclosed. Such an increase in the amount of mercury enclosed therein can cause meltdowns of the metallic foil more notably.

Accordingly, it is an object of the present invention to prevent an electrode from deforming, thereby certainly preventing a metallic foil from melting down in an extra high pressure mercury lamp.

One of aspects of the present invention is an extra high pressure mercury lamp comprising: an arc tube including a light emission section that encloses 0.2 mg/mm$^3$ or more of mercury, sealing sections that respectively extend from both ends of the light emission section, a pair of electrodes which face each other in the light emission section, and a metallic foil that is buried in the sealing section and is electrically connected with the electrode axis portion; an extended portion that extends towards the outside in a tube axis direction and extends from the covering portion; and a main body portion that extends from the extended portion, wherein the metallic foil has a covering portion fixed to the electrode axis portion so as to roll up the electrode axis portion, without being connected with the electrode axis portion, and wherein an electrode axis portion of each electrode is held by the sealing portion.

In the extra high pressure mercury lamp, the covering portion may be cylindrical.

In the extra high pressure mercury lamp, the metallic foil may include a gradually increasing width portion whose width is gradually larger in a direction opposite to that towards the covering portion, which is formed between the extended portion and the main portion.

In the extra high pressure mercury lamp of the present invention, the metallic foil has the covering portion fixed to the electrode axis portion so as to roll up the electrode axis portion, and the extended portion which extends towards the outside in a tube axis direction and extends from the covering portion, without being connected with the electrode axis portion. Therefore, the circumference of the electrode axis portion is covered with the covering section of the metallic foil, so that the glass, which forms the sealing portion, is brought into close contact with the circumference of the covering section. Therefore, since the electrode does not deform so as to curve even though the extra high pressure mercury lamp is turned on and off repeatedly, it is possible to certainly prevent a meltdown of the metallic foil that attributes to the deformation of the electrode.

BRIEF DESCRIPTION OF THE DRAWINGS

Other features and advantages of the present high pressure discharge lamp will be apparent from the ensuing description, taken in conjunction with the accompanying drawings, in which.

DESCRIPTION

Figure 1:
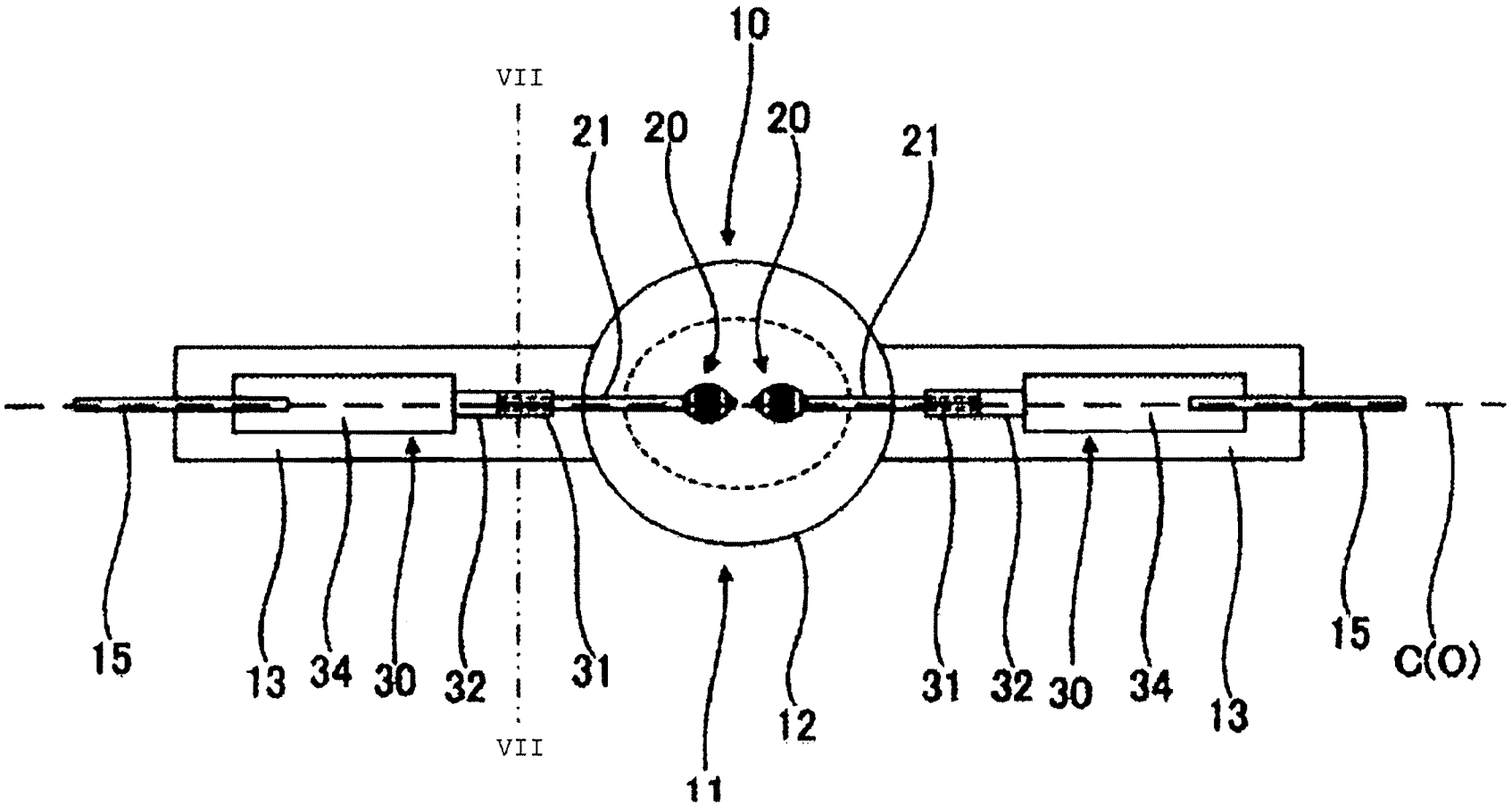
FIG. 1 is a cross sectional view of a schematic structure of an extra high pressure mercury lamp according to the present invention, taken in a tube axis direction.

FIG. 1 is a cross sectional view of a schematic structure of an extra high pressure mercury lamp according to the present invention, taken in a longitudinal direction of the lamp. This extra high pressure mercury lamp 10 includes an arc tube 11 which is made up of a spherical light emission section 12 and rod shape sealing portions 13, which respectively extend from both ends of the light emission section 12 in a tube axis direction towards the outside thereof, wherein the arc tube 11 is made of quartz glass. The sealing portions 13 are formed by, for example, a shrink sealing method, and a cross sectional view thereof is a circle in shape.

A pair of electrodes 20, which are made of tungsten respectively and face each other, are arranged apart from each other at a distance of 0.5-2.0 mm inside the light emission section 12. Part of each electrode 20 in a tip end side thereof is projected into the light emission section 12, and a base portion thereof is held in each sealing portion 13. Each of the electrodes is electrically connected with each metallic foil 30 buried in each sealing portion 13. Each metallic foil 30 is made of molybdenum. Each external lead 15, which projects in a tube axis direction toward the outside thereof from an outer end portion of the sealing portion, is electrically connected to each metallic foil 30.

Mercury, rare gas, and halogen gas are enclosed inside the light emission section 12. The amount of mercury enclosed therein is, for example, 0.2 mg/mm$^3$ or more, so that the mercury vapor pressure in the light emission section 12 may turn into 200 atmospheric pressure or more at time of lighting. Rare gas is used for improving the starting nature of the extra high pressure mercury lamp, and, for example, argon gas of 13 kPa is enclosed as the rare gas. Halogen gas is used for prolonging the life span of the lamp by using the halogen cycle, and for preventing breakage and devitrification of the light emission section 11. The enclosed amount thereof is suitably adjusted within a range of $10^{-6}$-$10^{-2}$ μmol/mm$^3$ according to the specification of the lamp.

Figure 2:
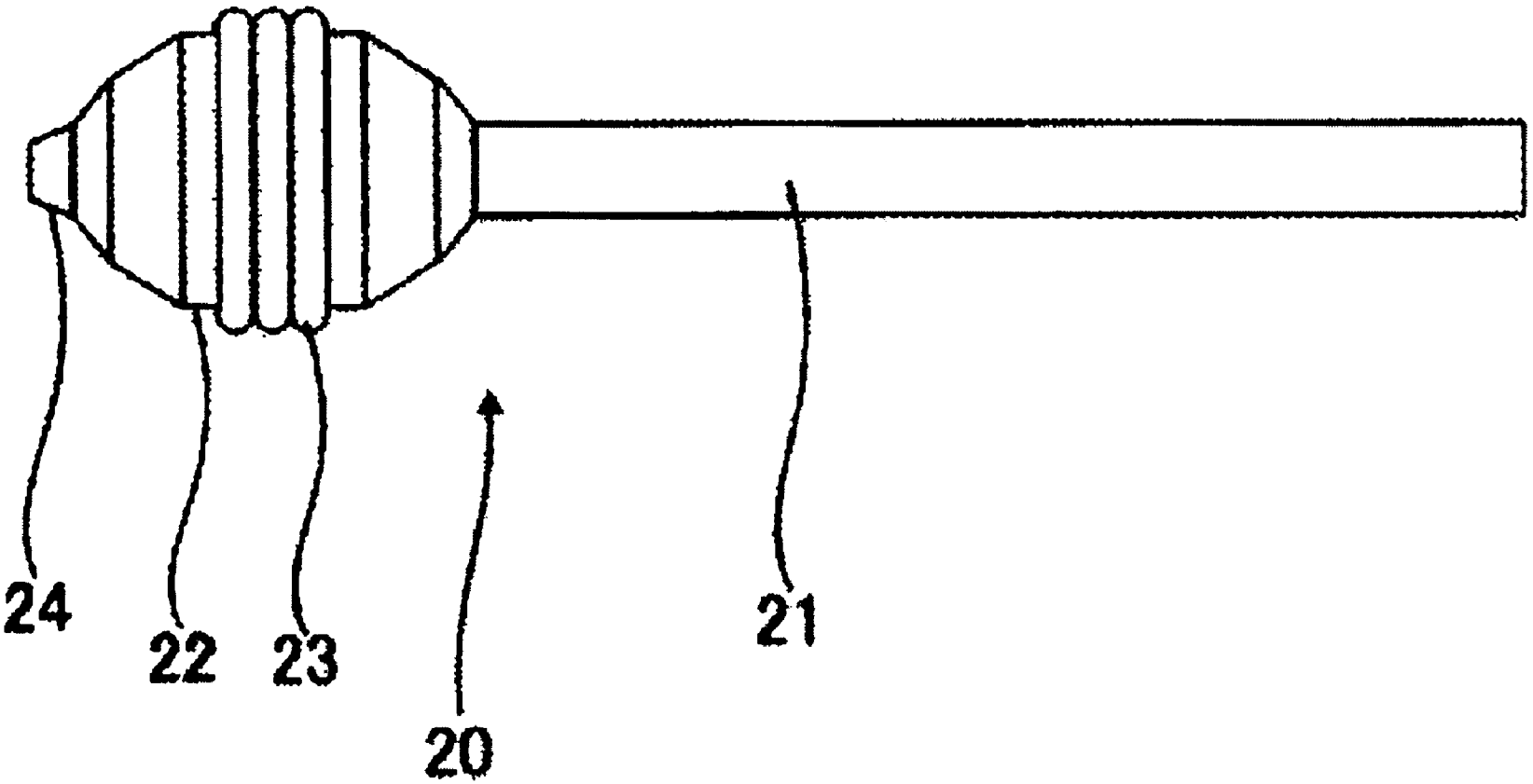
FIG. 2 is an enlarged view of the structure of an electrode.

FIG. 2 shows an enlarged view of an electrode of the extra high pressure mercury lamp shown in FIG. 1. Each electrode 20 of the extra high pressure mercury lamp is made up of a cylindrical electrode axis portion 21 and an electrode main body section 22, which is formed at the tip of the electrode axis portion 21. The electrode axis portion 21 and the electrode main body section 22 are made of tungsten. A coil section 23 is formed in the circumference of the electrode main body section 22 by winding a wire rod made of tungsten therearound. The coil section 23 is provided in order to improve the starting nature of the extra high pressure mercury lamp. A projection section 24 in the shape of a truncated cone, in which the outer diameter thereof gradually reduces in size as it moves closer to the other electrode, is formed at a tip section of the electrode main body section 22. The projection section 24 is provided so as to make it easy to concentrate an electric discharge arc at time of lighting. Such an electrode 20 is arranged in a state where the central axis O of the electrode axis portion 21 is in agreement with the tube axis C of the arc tube while the entire electrode main body section 22 is projects in the sealed space of the light emission section 12.

In the extra high pressure mercury lamp 10, which has such electrodes 20, when alternating current electric power is impressed between the pair of electrodes 20, dielectric breakdown is produced between the electrodes 20 so that an electric discharge arc is formed at the projection section 24 of each electrode 20 as the starting point thereof. For example, light including visible light of a waveform of 360 to 780 nm is emitted.

Figure 3:
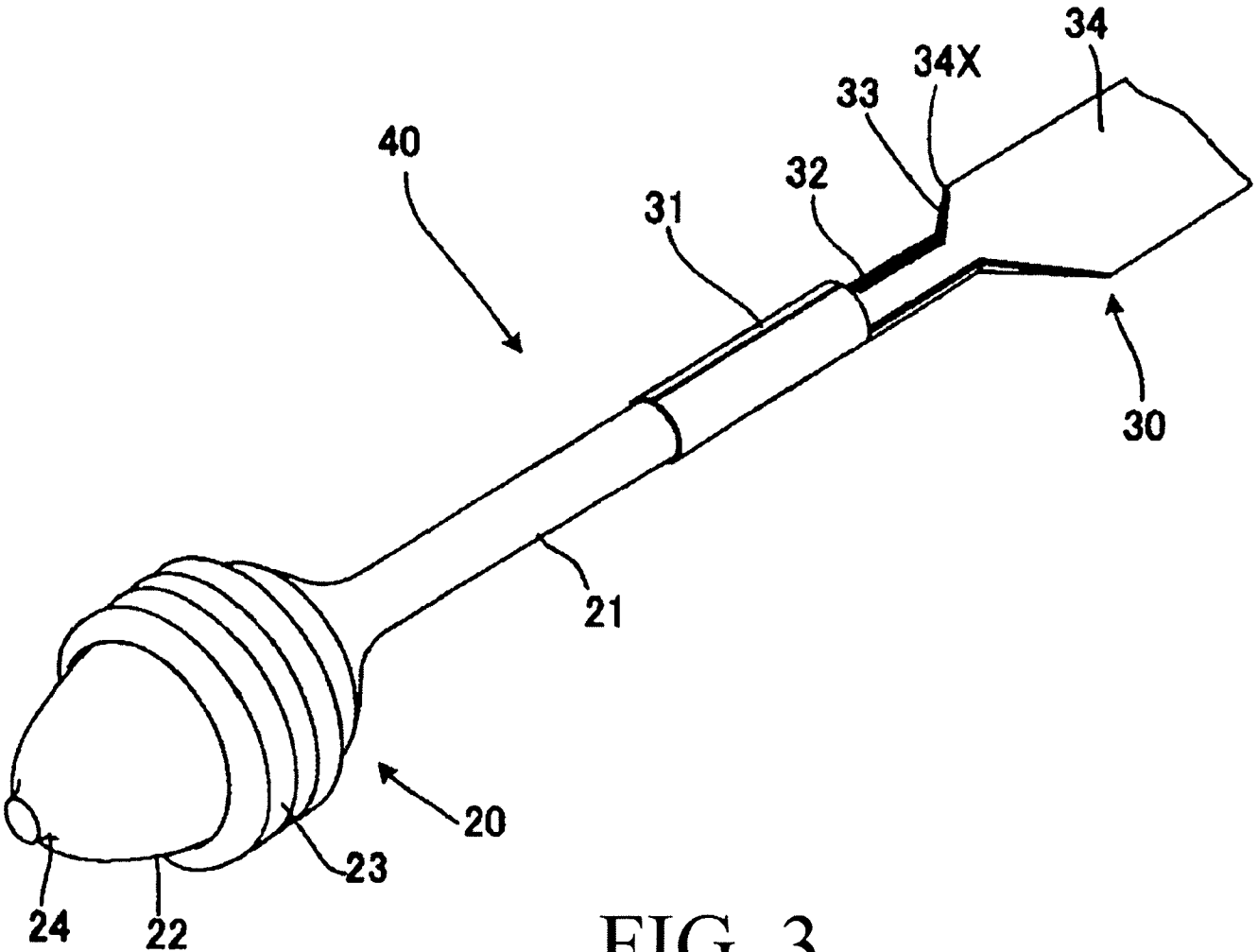
FIG. 3 is a perspective view of the structure of an electrode mount.
Figure 4:
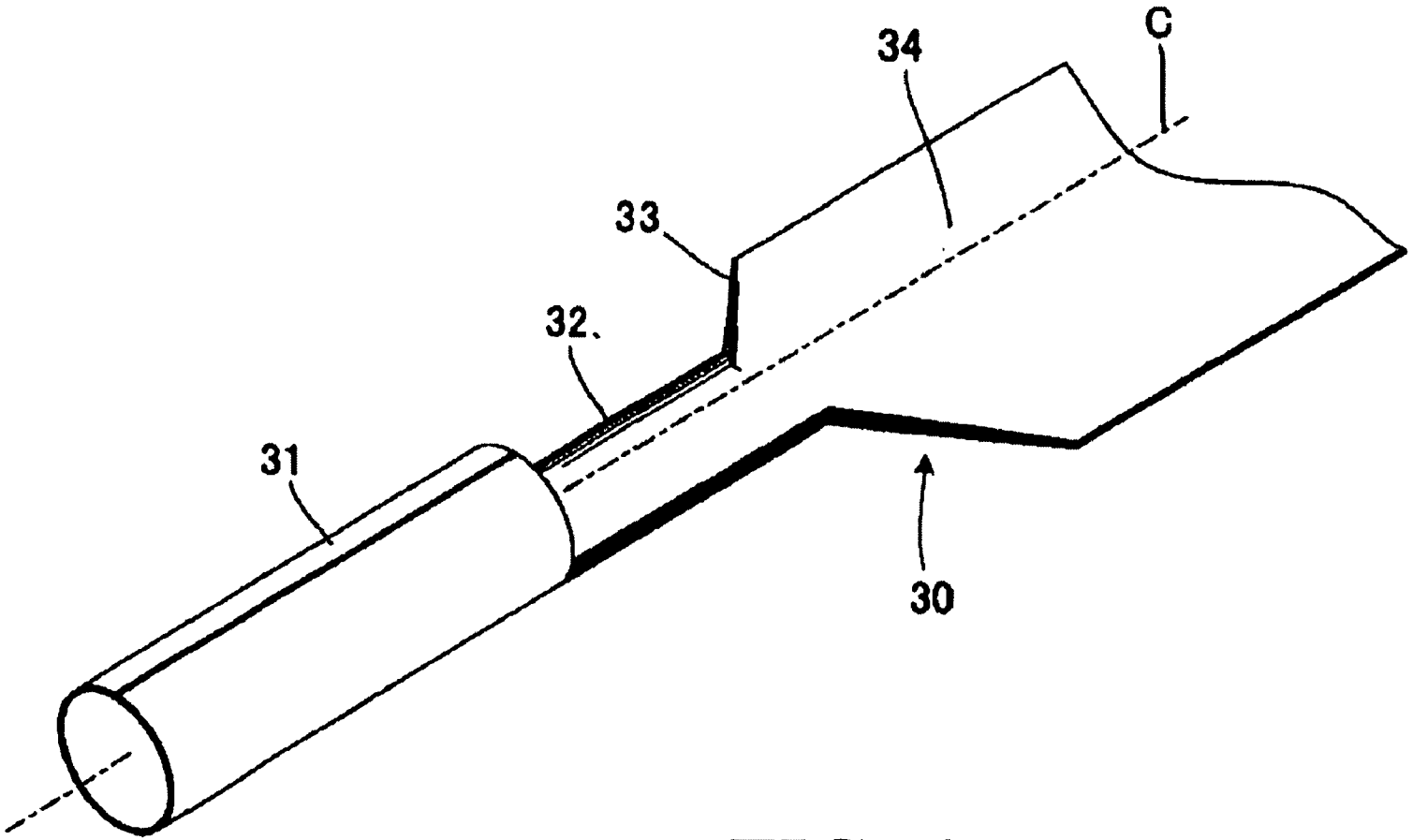
FIG. 4 is a perspective view of the structure of a metallic foil.

FIG. 3 is a perspective view of the structure of an electrode mount which is made up of a metallic foil and an electrode. FIG. 4 is a perspective view of the structure of the metallic foil in a state that is prior to joining the metallic foil to an electrode axis portion. As shown in FIG. 4, the metallic foil 30 includes a cylindrical covering section 31, which has the shape corresponding to the shape of the electrode axis portion 21; an extended portion 32 having a gutter-like shape, which extends in a direction of the tube axis C toward the outside (a direction opposite to the covering section 31 on paper in which FIG. 4 is shown) without being connected with the electrode axis portion 21; a gradually increasing width portion 33, which is formed so that the width gradually increases in a direction of the tube axis toward the outside; and a flat main body section 34, which extends from a base side of the gradually increasing width portion 33. The projection width of the main body section 34 is larger than the projection width of the extended portion 32. The covering section 31 is arranged on an outer face of the electrode axis portion 21, so as to roll up the electrode axis portion 21, and is fixed, in an integrated fashion, to the electrode axis portion 21 by means such as laser welding or resistance welding. Although not shown in the figure, an external lead 15 for electric supply shown in FIG. 1 is connected to a base side of the main body section 34. In such a manner, the electrode mount 40 shown in FIG. 3 is completed.

Figure 5:
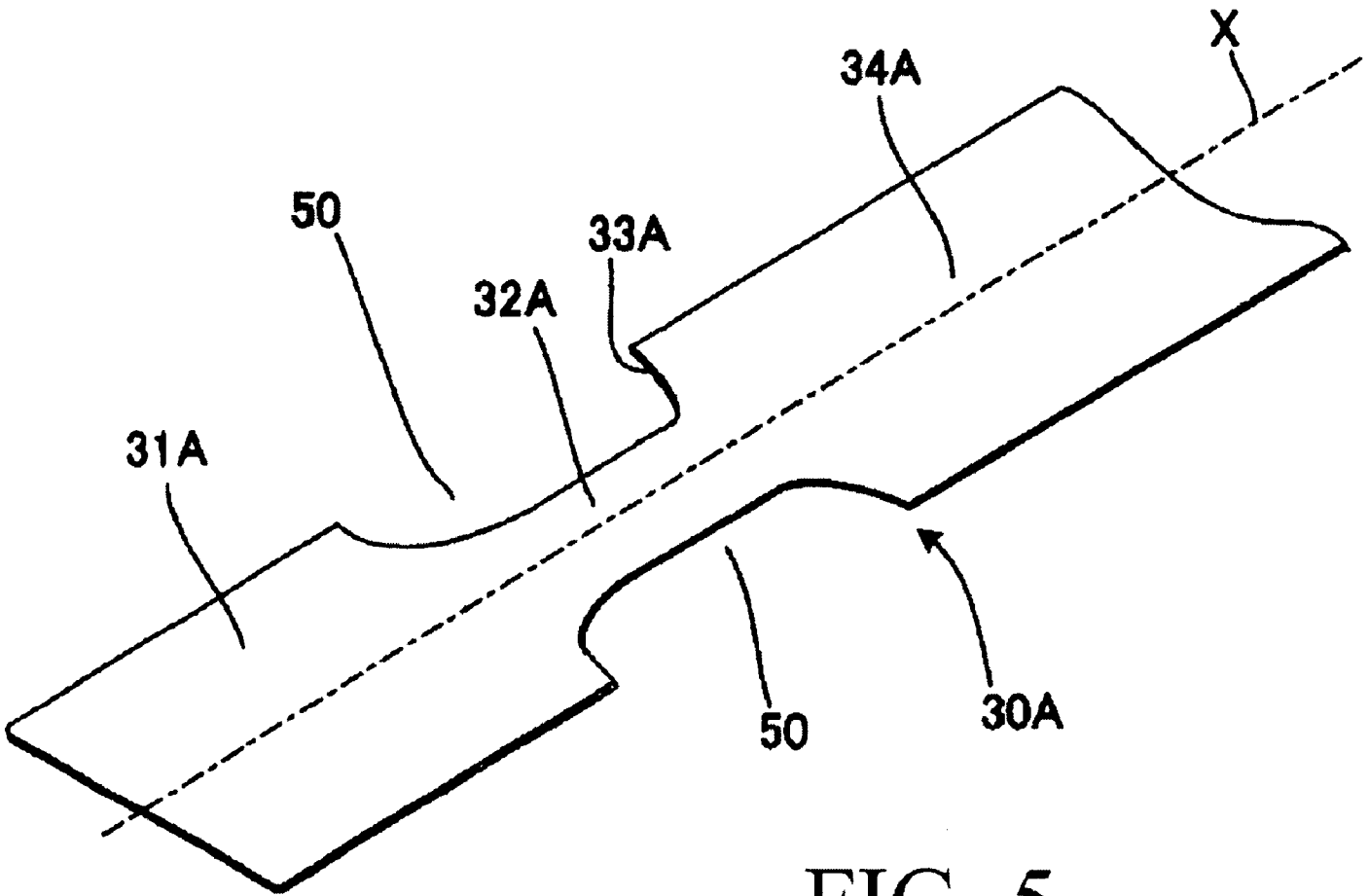
FIG. 5 is a perspective view of the structure of a metallic foil in an early stage.

FIG. 5 is a perspective view of the structure of the metallic foil in a state that is before forming the covering section is formed. As shown in FIG. 5, the metallic foil 30A includes a small width section 32A, which is formed at a predetermined distance from a tip thereof; and large width sections 31A and 34A, which are formed so that the small width section 32A is located therebetween in a longitudinal direction of the metallic foil, which are continuously formed from a tip end side of the small width section 32A and a base end side thereof respectively, and which extend in width directions of the metallic foil, respectively. The small width section 32A is formed by forming, apart from the tip of the metallic foil 30A, a pair of cut-out portions 50, each of which curves towards the central-axis X of the metallic foil 30A, and has the same shape as each other. Oblique side sections 33A are formed between the small width section 32A and the large width section 34A, and the respective oblique side sections 33A become gradually small in width, as close to the small width section 32A.

Figure 6A:
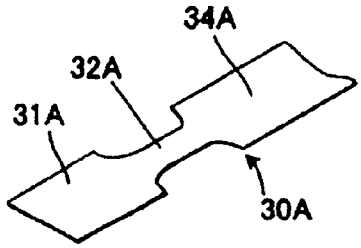
FIG. 6 is a conceptual diagram for explaining a manufacture method of an electrode mount.
Figure 6B:
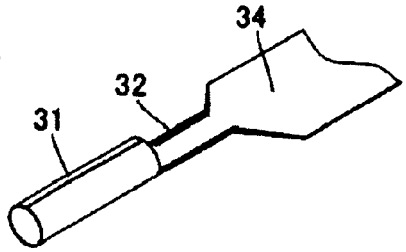
Figure 6C:
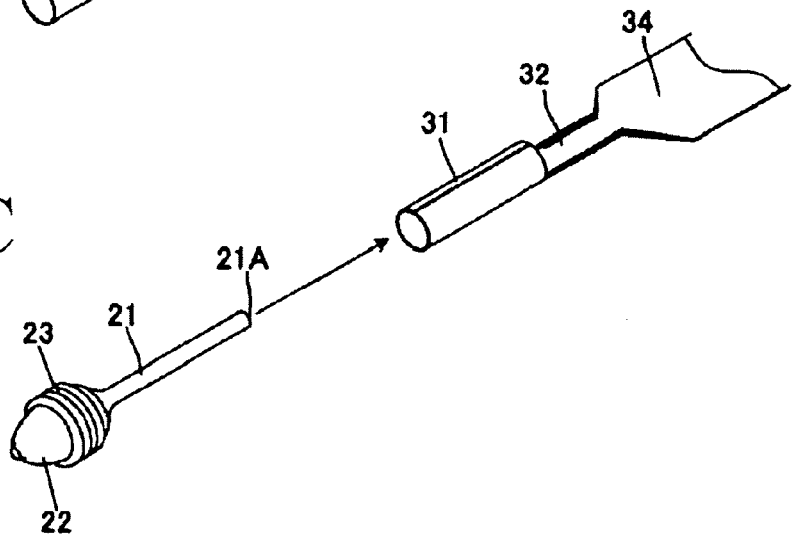
Figure 6D:
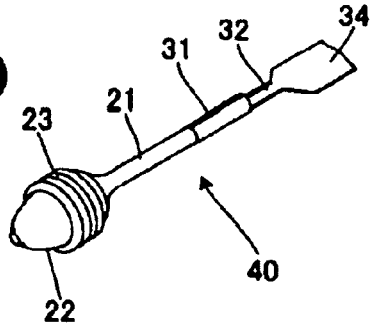

FIGS. 6A, 6B, 6C and 6D are perspective views for explaining a manufacture method of electrode mount of FIG. 3. Specifically, FIG. 6A shows a metallic foil in an initial state which is before a covering section is formed. FIG. 6B shows the metallic foil in the state where the covering section is formed. FIG. 6C shows a step of inserting a base portion of an electrode into the covering section of the metallic foil. FIG. 6D shows a completed electrode mount.

As shown in FIG. 6B, while the metallic foil 30 is formed by bending the large width section 31A shown in FIG. 6A from both sides of the metallic foil in the width direction, so as to fit for the shape of the electrode axis portion 21 and so that the both ends of the large width sections 31A in the width direction do not overlap each other, the small width section 32A is formed approximately in the shape of gutter in a cross sectional view thereof. Thus, as shown in FIG. 6B, the cylindrical covering section 31 which has an outer diameter slightly larger than that of the electrode axis portion 21 is formed by forming the large width section 31A. It is not necessary to bend the large width section 31A so that a perfect tube body may be formed, as long as the large width section 31A is arranged around the electrode axis portion 21 so as to sandwich the electrode axis portion 21 from both side thereof. That is, both ends of the large width section 31A in the width direction may be slightly apart from each other.

Next, as shown in FIG. 6C, a base section 21A of the electrode axis portion 21 and the covering section 31 of the metallic foil 30 are arranged so as to face each other, and then the electrode axis portion 21 is moved towards the covering section 31 from a side of the base section 21A of the electrode axis portion 21 so that the base section 21A of the electrode axis portion 21 is inserted in the covering section 31. Then, the outer circumference of the covering section 31 is irradiated with a laser from the outside of the covering section 31, so that the covering section 31 is integrally fixed to the electrode axis portion 21. In addition, the covering section 31 may be fixed to the electrode axis portion 21 by resistance welding. By performing such a series of steps, an electrode mount 40 shown in FIG. 6D is obtained. The electrode mount 40 produced by such steps is accommodated inside the arc tube forming material, which is made of quartz glass, and then it is air tightly sealed therein by performing a sealing process such as shrink sealing etc., so that the sealing portion 13 shown in FIG. 1 is formed. In the metallic foil 30, the covering section 31, the extended portion 32, the gradually increasing width portion 33, and the main body section 34 are in close contact with the quartz glass which forms the sealing portion 13.

Figure 7:
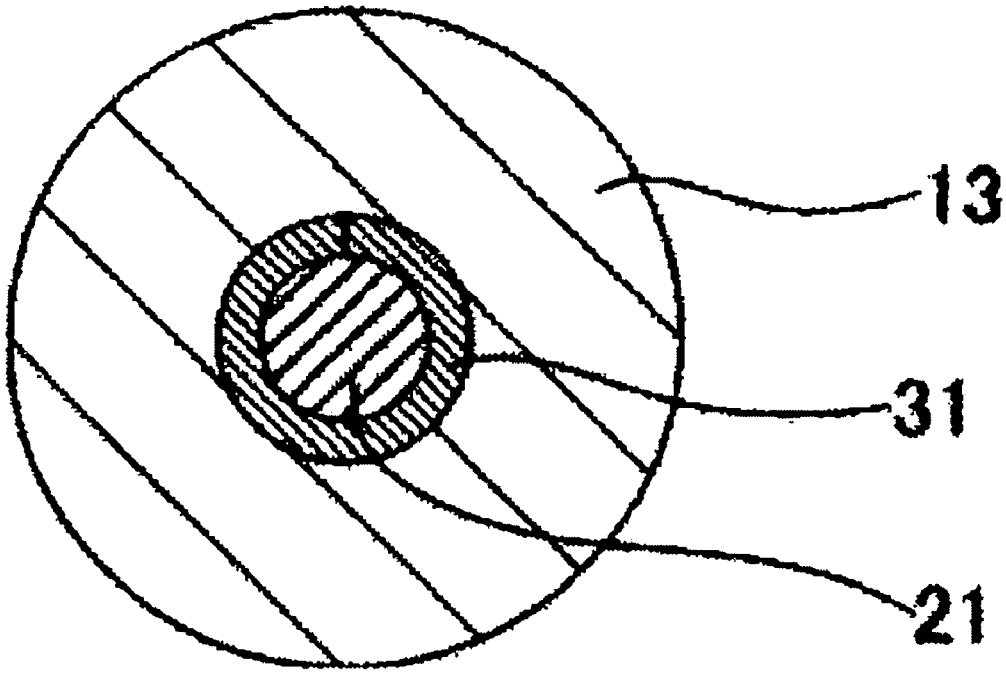
FIG. 7 is a cross sectional view of an extra high pressure mercury lamp of FIG. 1, taken along a line VII-VII.
Figure 8:
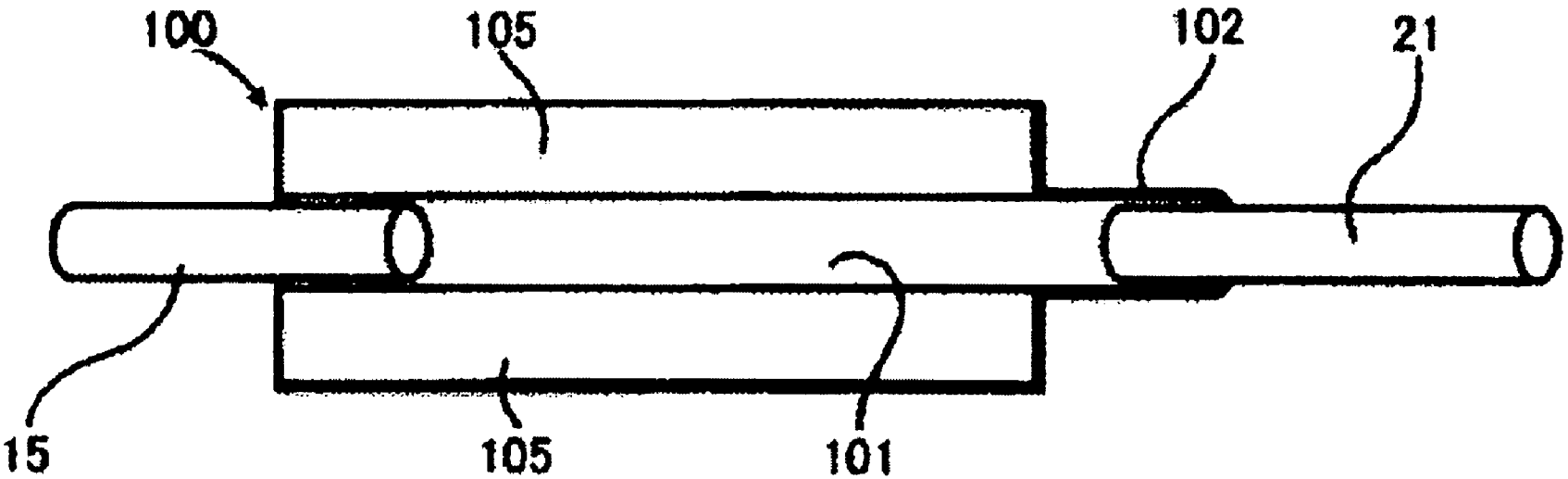
FIG. 8 Prior Art
FIG. 8 is a perspective view showing the structure of a metallic foil with an electrode axis portion and an external lead in a conventional extra high pressure mercury lamp.
Figure 9:
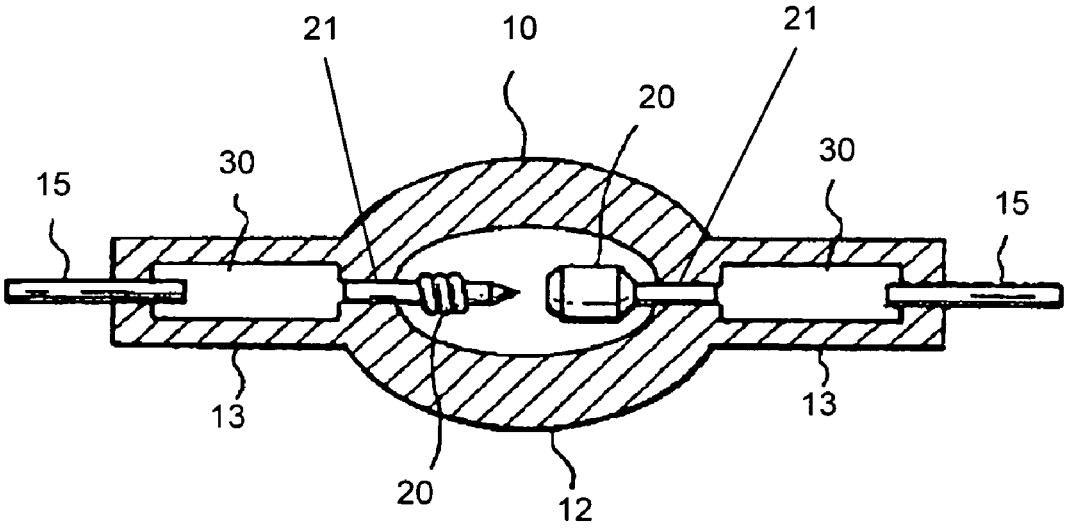
FIG. 9 is a cross sectional view of a schematic structure of a conventional extra high pressure mercury lamp, taken in a tube axis direction.

In the extra high pressure mercury lamp according to the present invention, in a connecting portion of the electrode axis portion 21 and the metallic foil 30 which are held by the sealing portion 13, since, as shown in the cross section view of FIG. 7, the electrode axis portion 21 is covered by the covering section 31, the covering section 31 of the metallic foil 30 is provided between the electrode axis portion 21 and the quartz glass that forms the sealing portion 13, whereby the electrode axis portion 21 is not in contact with the glass that forms the sealing portion 13 completely, or it is possible to maximally reduce the contact area of the electrode axis portion 21 and the glass. That is, in the connecting portion of the electrode axis portion 21 and the metallic foil 30, it is possible to evenly bring the glass, which forms the sealing portion 13, into close contact with the circumference of the covering section 31. Therefore, since each part of the electrode axis portion 21 does not deform even though the extra high pressure mercury lamp 10 is repeatedly turned on and off, the thickness of metallic foil becoming locally thin is prevented, whereby preventing meltdown of the metallic foil 30 is certainly possible. In addition, as shown in FIGS. 1 and 3, in the extra high pressure mercury lamp 10 of the present invention, since the metallic foil 30 that has the gutter shaped-extended portion 32 which extends towards the outside thereof in the tube axis direction and which is not connected with the electrode axis portion 21 following the covering section 31, is buried in the sealing portion 13, the metallic foil 30 does not come off from the quartz glass which forms the sealing portion 13. This reason is considered as set forth below, although it is not certain.

In the sealing portion 13 of the extra high pressure mercury lamp 10, minute gaps are inevitably formed between the electrode axis portion 21 and the quartz glass that forms a sealing portion 13. Minute gaps are formed between the electrode axis portion 21 and the quartz glass around the electrode axis portion 21, and between the covering section 31 which covers the circumference of the electrode axis portion 21, and the quartz glass around the covering section 31. At time of lighting of the extra high pressure mercury lamp, the high pressure of the light emission section 12 is applied to these minute gaps.

An extra high pressure mercury lamp (an embodiment) which includes the metallic foil 30 having the structure shown in FIG. 3 and an extra high pressure mercury lamp (comparative example) in which a metallic foil shown in FIG. 3 does not have an extended portion 32, will be explained below, comparing them with each other. In the lamp according to the embodiment, the extended portion 32 extends from a back edge of the covering section 31, and this extended portion 32 is sealed so as to be in close contact with the quartz glass which forms the sealing portion 13. Therefore, the high pressure in the light emission section 12 at time of lighting is not applied to the angle sections 34X of the main body section 34 through the above-mentioned minute gaps, so that distortion is not produced in the main body section 34. Therefore, the main body section 34 and the quartz glass which forms the sealing portion 13 are not separated from each other. On the other hand, since the comparative example did not have the extended portion 32 which extends from the back edge of the covering section 31, and has a spread to the width of the main body section 34 immediately from the back edge of the covering section 31, angle sections 34X are formed so that stress tends to concentrate on these portion. Consequently, the high pressure at time of lighting in the light emission section 12 is applied to the angle sections 34X of the main body section 34 through the above-mentioned minute gaps, so that distortion thereof occurs, whereby there is a possibility that the quartz glass which forms the main body section 34 and the sealing portion 13 are separated from each other.

Furthermore, in the extra high pressure mercury lamp 10 of the present invention, as shown in FIG. 3, the metallic foil 30 is buried in the sealing portion 13, wherein the metallic foil 30 has the structure in which the gradually increasing width portion 33 whose width becomes gradually large towards the outside of the tube axis is formed between the extended portion 32 and the main body section 34. Therefore, it is expected that distortion of the main body section 34 is further suppressed. In addition, in the metallic foil 30 of the present invention, the gradually increasing width portion 33 is not an indispensable element. That is, the metallic foil has the structure only having: the covering section 31 connected to the electrode axis portion 21 so as to roll up the electrode axis portion 21; the gutter-shaped extended portion 32 which extends from the covering section 31 towards the outside in the tube axis direction, without being connected to the electrode axis portion 21; and the main body section 34. Even if the lamp is an extra high pressure mercury lamp having the sealing portion 13 in which the above-described metallic foil 30 is buried, the above-mentioned effect is expected.

The specification of the embodiment of the extra high pressure mercury lamp by which the effects of the above-mentioned present invention have been confirmed will be described below. An arc tube 11 is 70 mm in full length, and the outer diameter thereof is 10 mm. The arc tube 11 is 66 $mm^3$ in internal volume. The amount of mercury enclosed is 0.3 $mg/mm^3$. A metallic foil 30 is 14 mm in full length and 0.02 mm in thickness. An extended portion 32 is in the shape of a gutter. The extended portion 32 is 0.5 mm in projection width and 1.4 mm in full length. A gradually increasing width portion 33 is 0.4 mm in full length. A main body section 34 is 1.5 mm in width and 11 mm in full length. An electrode axis portion 21 is ø 0.4 mm in diameter.

The extra high pressure mercury lamp of the present invention is not limited to the above-mentioned embodiment, and various changes of design are possible. For example, although the extended portion 32 of the metallic foil 30 is in the shape of a gutter as shown in FIGS. 3 and 4, the extended portion 32 may be, for example, in the shape of a plate. Moreover, as shown in FIG. 7, the main body section of the metallic foil may be formed in the omega (Ω) shape as a whole by forming a slot portion extending in parallel to the tube axis and in the center in a width direction.

The preceding description has been presented only to illustrate and describe exemplary embodiments of the present extra high pressure mercury lamp. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than what is specifically explained and illustrated without departing from its spirit or scope.

What is claimed is:

1. An extra high pressure mercury lamp comprising:

an arc tube including a light emission section that encloses 0.2 $mg/mm^3$ or more of mercury, sealing sections that respectively extend from both ends of the light emission section, a pair of electrodes which face each other in the light emission section, and a metallic foil that is buried in the sealing section and is electrically connected with the electrode axis portion;

an extended portion that extends towards the outside in a tube axis direction and extends from a covering portion; and a main body portion that extends from the extended portion, wherein the metallic foil has the covering portion fixed to the electrode axis portion so as to roll up the electrode axis portion, without being connected with the electrode axis portion, and wherein an electrode axis portion of each electrode is held by the sealing portion.

2. The extra high pressure mercury lamp according to claim 1, wherein the covering portion is cylindrical.

3. The extra high pressure mercury lamp according to claim 1, wherein the metallic foil includes a gradually increasing width portion whose width is gradually larger in a direction opposite to that towards the covering portion, which is formed between the extended portion and the main portion.

* * * * *